United States Patent [19]

Nagy

[11] Patent Number: 4,752,063

[45] Date of Patent: Jun. 21, 1988

[54] FLEXIBLE ELEMENT VISE ATTACHMENT

[75] Inventor: Bela Nagy, Fallbrook, Calif.

[73] Assignee: West Ventures Enterprises, Inc., San Marcos, Calif.

[21] Appl. No.: 26,462

[22] Filed: Mar. 16, 1987

[51] Int. Cl.[4] ..... B25B 1/24

[52] U.S. Cl. ..... 269/266

[58] Field of Search ..... 269/266, 254 CS, 224

[56] References Cited

U.S. PATENT DOCUMENTS

| | | | |
|---|---|---|---|
| 1,256,217 | 2/1918 | Fieldhouse | 269/266 |
| 1,548,730 | 8/1925 | Mirfield . | |
| 2,658,415 | 11/1953 | Barowsky . | |
| 2,754,708 | 7/1956 | Peterson . | |
| 3,604,700 | 9/1971 | Gault . | |
| 3,818,646 | 6/1974 | Peterson . | |
| 3,858,468 | 1/1975 | Pasbrig . | |
| 4,047,709 | 9/1977 | Thyberg et al. . | |

*Primary Examiner*—Robert C. Watson

*Attorney, Agent, or Firm*—Brown, Martin, Haller & Meador

[57] ABSTRACT

A vise attachment for use on a vise assembly for holding objects having irregularly-shaped surfaces, comprising a small compact housing having a plurality of blade elements disposed adjacent to each other and slidably mounted within a rectangular opening on one side of the housing and movable between an extended position and a retracted position. Each element preferably comprises a plate member having smooth planar surfaces and a concave curved back edge and stop means disposed on upper and lower edges for setting a limit for extension of the blade from the housing. A self-distributing non-resilient medium is positioned within the housing and has a predetermined volume for filling the housing when the blades are in a retracted position. A distribution and reset means causes the blades to reposition themselves to extend fully through the rectangular opening when not holding an object.

20 Claims, 2 Drawing Sheets

FIG. 1
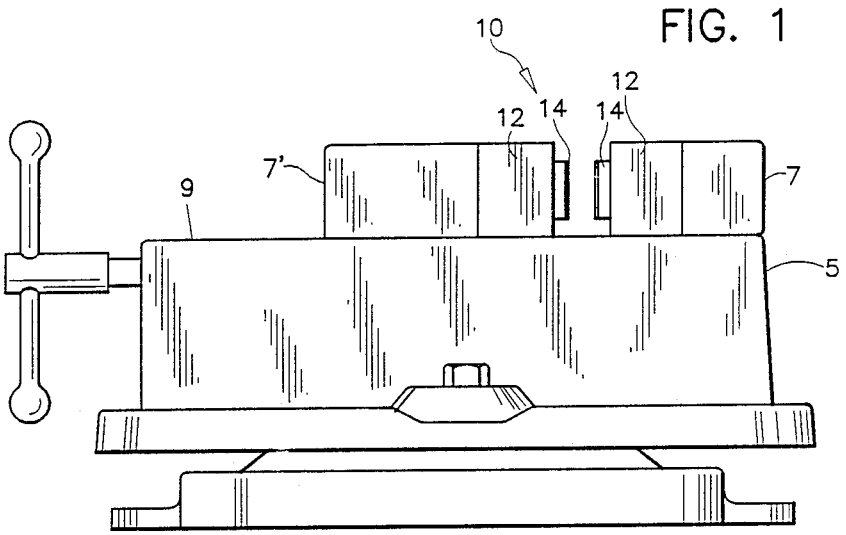
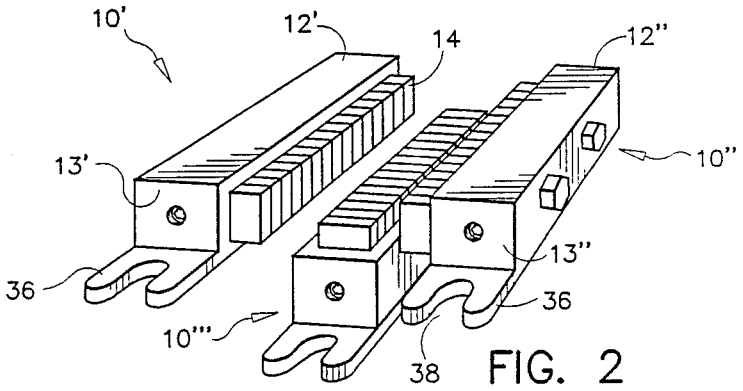
FIG. 2
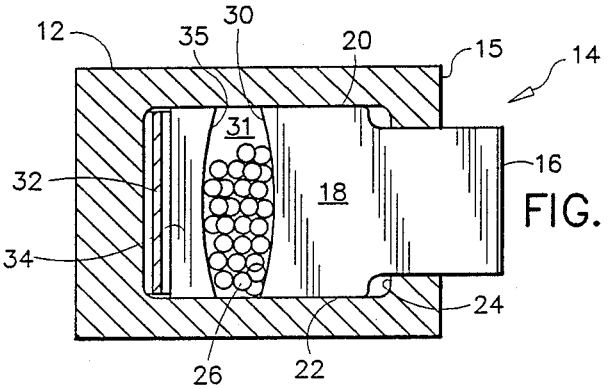
FIG. 3

FLEXIBLE ELEMENT VISE ATTACHMENT

BACKGROUND OF THE INVENTION

1. Field of the Invention

The present invention relates to vises and more particularly to a vise attachment having a series of independently positioned blades or elements for automatically conforming to the surface contours of irregularly-shaped objects. The invention further relates to a cost efficient, low complexity vise attachment for automaticaly accommodating objects having irregular contours in multiple axis and which resets itself for receiving new objects upon removal of a previously held object.

2. Background

There has long been a need in many endeavors, including advanced technology machining, aerospace development, and scientific research, to hold or clamp irregularly-shaped objects in a fixed position for machining, inspection, or assembly work. However, many of the irregularly-shaped objects have highly complex and convoluted surface angles, structures, or contours which make holding such objects very difficult. In the past, a number of clamps might be used in combination with various shims, filler blocks, or specialized jigs to hold such objects. It is not uncommon in the aerospace industry, for example, to manufacture highly specialized brackets or jigs for holding key parts or components during certain assembly or machining operations. However, this is both time consuming and costly in terms of the extra materials and parts consumed.

Therefore, a variety of specialized holding and clamping devices have been developed in an attempt to accommodate irregularly-shaped objects. Examples of such devices are found in U.S. Pat. Nos. 3,818,646, 4,047,709, and 2,658,415. While these and other devices represent an improvement in the art of holding irregularly-shaped objects, they suffer from several drawbacks that have prevented widespread application in the machining arts.

U.S. Pat. No. 3,818,646 illustrates a special fixture for holding precisely shaped parts. The fixture employs a series of opposing fingers to press against opposite sides of a curved or irregularly-shaped object and hold it in place. One or more set screws and bolts are then pressed laterally against the sides of the fingers to fix them in position against the object. This type of fixture finds use in holding a curved turbine blade or similar object for final assembly or machining.

Apparatus exemplified by U.S. Pat. No. 3,818,646 are similar to the aforedescribed jigs and specialty fixtures developed in the art for holding irregularly-shaped parts. This type of fixture is a stand alone device usable only with a limited range of parts or objects for which it has been specifically dimensioned. The fixture has a preplanned and fixed maximum separation distance between opposing fingers that limits the thickness of objects for which this apparatus is usable. Also, the fingers require manual manipulation by an operator in order to conform to a new object or for releasing a previously held object. In addition, the pressure applied laterally to the sides of the fingers to lock them in place is insufficient to prevent finger movement under many clamping loads.

U.S. Pat. No. 4,047,709 discloses a clamping device that uses a clamping jaw having a plurality of movable plungers extending from one face of a housing. The plungers interact with the exterior surfaces of an irregularly-shaped object to position themselves at various projected lengths from the face of the clamping device. Hydraulic pressure is then used to press a medium, generally comprising spherical balls, into a series of annular depressions on the sides of the plungers to lock them in place.

Apparatus exemplified by U.S. Pat. No. 4,047,709 require a source of hydraulic fluid and some form of pressure control apparatus for operation. This increases complexity, cost, and maintenance, as well as sources of device failure. Unlike the U.S. Pat. No. 2,658,415 device, the plungers can return to a "neutral" position after an object is removed and pressure is applied to the medium. However, the apparatus required for operation and overall structure generally preclude utilization of this type of clamping device in applications other than on specially configured work surfaces or assemblies. Also, there are limitations on using pressure actuation on very thin or fragile parts.

U.S. Pat. No. 2,658,415 discloses an adjustable vise assembly for holding irregularly-shaped objects. The vise utilizes a pair of opposing jaws, each having a series of individual jaw segments that are extendable at different lengths from the face of the jaw. A reservoir of displaceable material positioned behind the segments distributes the load to adjacent segments and a back housing wall. Various cams and levers are used to press against the jaw segments in order to lock them in place or move them to new positions. A variety of parts may be repetitively inserted in the jaws of this vise assembly because the jaws retain a given configuration.

Devices exemplified by U.S. Pat. No. 2,658,415 are very large and bulky devices suitable only for use in connection with large scale milling machines and the like. This type of device is a complex and costly stand alone vise assembly intended to replace existing equipment a user may already have for holding objects. While such devices clamp irregular surfaces for repetitive operations, they do not automatically realign themselves to a "neutral" position for accepting new irregularly-shaped objects. That is, manual adjustment or actuation of the jaw elements is required by an operator to return the clamping device to a non-aligned state for accommodating a new object.

What is needed then is a clamping device that is usable in a variety of clamping and machining situations, especially as related to existing vise assemblies, and automatically adjusts itself between a holding configuration and a neutral position upon removal of an irregularly-shaped object. It is very desirable to have an apparatus that is usable with existing vises or holding devices as well as having a minimum bulk and external structure. It is desirable to achieve these goals in a device which does not utilize complex pneumatic or media manipulation techniques or apparatus and is simple and reasonably inexpensive to manufacture. It is also desirable that any clamping device be capable of holding very thin or fragile objects as well as bulky or strong objects.

SUMMARY

With the above problems and disadvantages of the present art in mind, it is an object of the present invention to provide a device for clamping and holding irregularly-shaped objects in a fixed position which automatically conforms to the surface contours of the irregularly-shaped objects.

It is another object of the present invention to provide an apparatus for clamping and holding irregularly-shaped objects which automatically resets itself to a neutral position for receiving new objects.

It is an advantage of the present invention that it provides an apparatus for clamping and holding irregularly-shaped objects that is usable in association with existing vises and clamping apparatus.

It is an additional advantage of the present invention that it provides a cost effective and low complexity device for clamping and holding irregularly-shaped objects.

It is one purpose of the present invention to provide an apparatus for holding irregularly-shaped objects which is adjustable over multiple axis.

It is another purpose of the present invention to provide an apparatus for holding irregularly-shaped objects which is capable of holding very thin or fragile materials without damage or surface deformation.

These and other objects, purposes, and advantages are achieved in a vise attachment for use on a vise assembly for holding objects having irregularly-shaped surfaces, comprising a small compact housing preferably made from hardened steel and having an elongated rectangular opening on one side. A plurality of holding elements having front and back faces are disposed adajcent to each other and slidably mounted within the rectangular opening. The blades are movable between an extended position where a majority of the blade is positioned to extend out of the housing and a retracted position where a majority of the blade is positioned within the housing. A stop means sets a limit for extension of the blade from the housing when in the extended position. A self-distributing, non-resilient medium, preferably made from hardened steel spheres, is disposed within the housing and fills any remaining housing volume when the elements are in a retracted position. A reset and distribution means automatically moves the medium against the back face of the elements causing them to thus move through the rectangular opening until prevented from doing so by the stop means or by encountering an object.

In a preferred embodiment of the invention, the holding elements comprise generally rectangular plates having two substantially parallel sides and front, back, upper, and lower faces. The plate sides and front face are smooth planar surfaces with the back face configured in the form of a concave arc extending between said upper and lower faces. The concave arc repositions the medium adjacent to a central portion of the back face of the elements and, thus, focuses forces exerted on the elements by an object to the central portion and through the medium to the housing. The periphery of the front and back faces of the elements have a radiused or curved edge so as to form a generally convex arc between the two parallel sides.

In an alternative embodiment, the blades use a pivot member rotatably secured to the blade front face. The pivot member has a front contact face, top and bottom faces, and a rear support face. The support face comprises first and second planar support surfaces which extend between the top and bottom faces respectively and a vertical position centrally located between the top and bottom faces. The support surfaces slant outward away from the contact face at a predetermined first angle and intersect in a line. A cylindrical projection extends from the rear support face and has a longitudinal axis substantially coexistent with the intersection line of the support surfaces.

The blade front face has corresponding first and second planar surfaces extending between a relatively central vertical position and the upper and lower faces respectively and making a predetermined second angle therewith, the second angle being greater than the first angle. The surfaces are slanted to project toward the back face of the blade and intersect in a line. A cylindrical passage is disposed on the blade front face traversing between the parallel sides and having a central longitudinal axis which is substantially coexistent with the intersection line of the planar surfaces. The cylindrical passage has a diameter larger than the cylindrical projection so as to confine the projection in a rotatable manner. The combination of the cylindrical passage and the cylindrical projection forms a rotating blade hinge.

The stop means can comprise projections disposed on upper and lower faces of the elements for interacting with said housing and setting a predetermined limit for extension of said front face from said housing when in the extended position. The stop means can also be implemented by making a front portion of the blades, which extends outside of the housing, the same approximate height as the opening while a captured rear portion, which remains in the housing, is made higher.

The preferred reset means comprises a pressure plate disposed between a back side of the housing and the medium or spheres. The plate has a curved front surface facing the element back faces. A spring disposed between the pressure plate and the housing urges the plate toward the elements. In some embodiments, an adjustment means is coupled between the housing and the pressure plate for manually adjusting a position for the plate with respect to the housing sidewalls.

In further aspects of the invention, mounting means can be used for securing the vise attachment in place during use. Such means can comprise projections extending from the housing end walls having an aperture for passage of a fastening means for securing the vise attachment to a surface or a C or L shaped bracket secured to the housing and extending toward a jaw portion of a vise so as to hook over at least one edge of the jaw. The vise attachment of the present invention can also be combined with one or more similar vise attachments and secured to planar or other mounting surfaces for holding and clamping irregular-shaped objects thereon.

BRIEF DESCRIPTION OF THE DRAWINGS

The novel features of the present invention may be better understood from the accompanying description when taken in conjunction with the accompanying drawings in which like characters refer to like parts and in which:

FIG. 1 illustrates a perspective view of a vise attachment constructed according to the present invention in use on a vise assembly;

FIG. 2 illustrates an alternate embodiment of a vise constructed according to the present invention in use on a mounting surface;

FIG. 3 is a side sectional view of the vise attachment of FIG. 1;

DETAILED DESCRIPTION OF A PREFERRED EMBODIMENT

Figure 5:
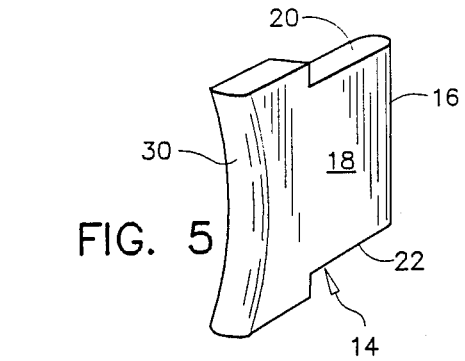
FIG. 5 is a perspective view of a single vise blade used in the apparatus of FIGS. 1, 2, and 3.

The present invention is a vise attachment for use on a vise assembly for holding objects having irregularly-shaped surfaces, comprising a compact housing having an elongated rectangular opening on one side. A plurality of blade elements are slidably mounted adjacent to each other within the rectangular opening and each blade comprises a generally rectangular plate member having smooth planar surfaces and a concave curved back face. The blades are movable between an extended position and a retracted position within the housing. A stop means sets a limit for extension of each element from the housing when in an extended position. A non-resilient medium in the form of a plurality of self-distributing spheres automatically positions itself inside the housing so as to fill any remaining housing volume when the elements are in a retracted position. A reset and distribution means is provided for assisting the redistribution of the spheres and for causing the elements to move through the rectangular opening until prevented from doing so by the stop means or by encountering an object. The elements can also be constructed to accommodate contour variations transverse to their sliding motion.

A vise attachment constructed according to the principles of the present invention is illustrated in use on a vise in FIG. 1. In FIG. 1, a vise 5 is shown having two vise attachments 10 mounted adjacent to each of two vise jaws 7. The vise 5 is a typical machinists vise having two opposing jaw structures 7 and 7' that slide back and forth on flat guide rails or structures 9. The vise 5 can employ either a fixed or swivel type base depending on whether extra degrees of freedom are desired.

The vise attachment 10, comprises a generally rectangular housing 12 containing a series of self adjusting vise elements or blades 14 which extend or project to engage objects to be held by the vise 5. The housing 12 has a lower sidewall which is dimensioned to rest on the same guide structure 9 used by the jaws 7 or 7' which provides several advantages.

First, the vise attachment 10 is usable with existing vises to adapt them for holding irregularly-shaped objects. This eliminates the necessity of separate dedicated or costly holding devices. Second, differing sizes of attachment 10 can be used in the vise 5 without major modifications. Third, the vise attachment 10 is easily inserted or removed from the vise 5 and single attachments 10 can be used where only one side of an object is irregularly shaped.

Figure 4:
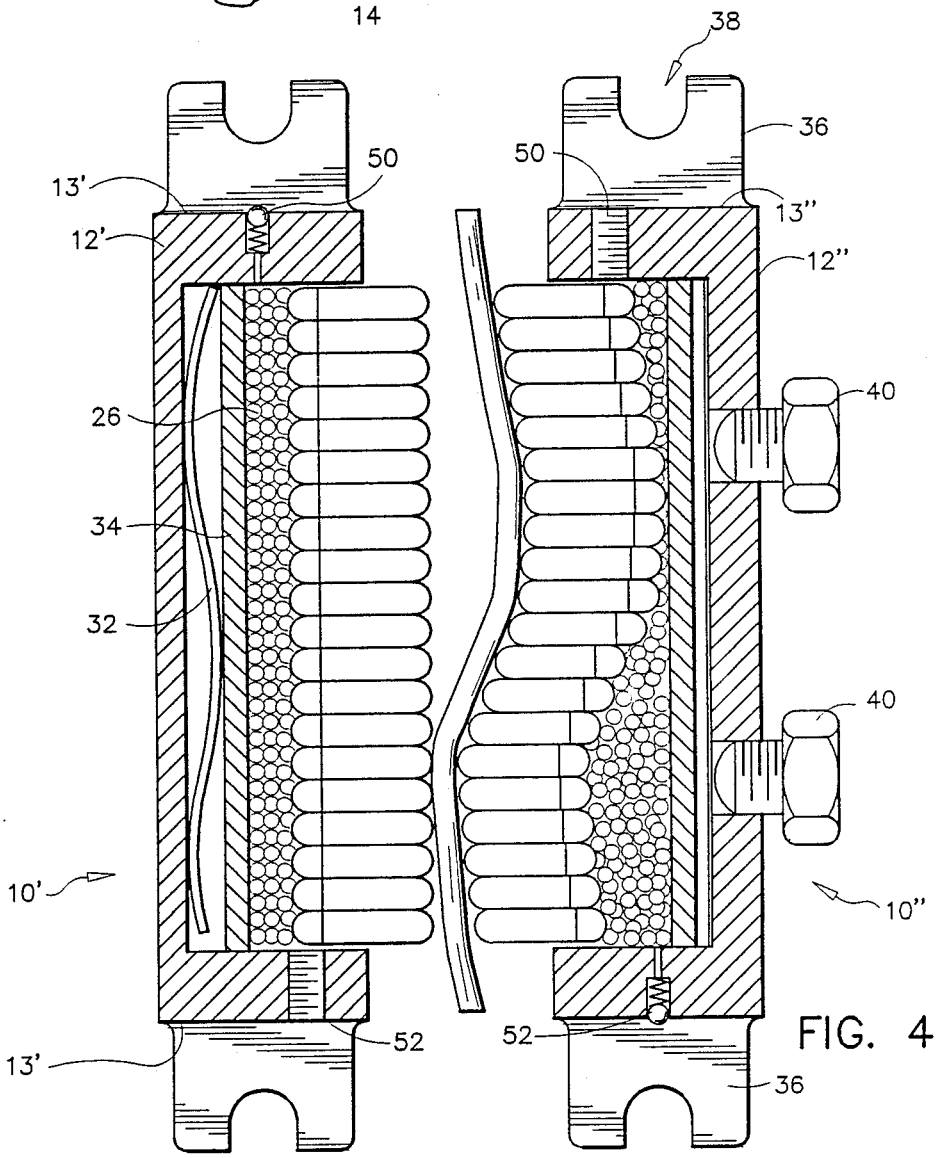
FIG. 4 is a top sectional view of a vise attachment of the present invention.

The operation of the vise attachment 10 is better understood or explained in reference to the cross sectional views of FIGS. 3 and 4. In FIG. 3, each vise element 14 has a front face 16 that extends toward an object to be clamped in the vise 5. The front face 16 is substantially planar but has a radius along it's peripheral edges to eliminate sharp protruding edges which can severely damage an object's exterior surface when adjacent blades 14 are positioned at widely variant projection distances from the housing 12. The radius along the edge of the face 16 also helps reduce binding and abrasion between adjacent elements 14 when they slide along each other to conform to irregularly-shaped objects.

The housing 12 comprises a generally U or square C shaped housing having three closed sidewalls or sides and an open front portion through or from which the blades 14 project. The enclosure of the housing 12 is completed using two end walls 13 which are held in place by means such as, but not limited to, welding, set screws, or pins. The front of the housing 12 has ridges or short wall projections 15 extending in from the sidewalls to form a raised edge or lip which is used to retain the blades 14 within the housing 12 by defining a rectangular aperture for the blades 14 in combination with two end walls 13. In the alternative, the front wall of the housing can be made as a larger sidewall with a rectangular opening machined therein having a height and width determined by the size desired for the blades 14.

A variety of materials can be used to manufacture the housing 12 including, but not limited to, steel, special tool alloys, high strength composites or plastics, or other metals such as aluminum. However, the advantages of the present invention are most realized in applications requiring fairly large clamping forces. In these applications the preferred housing material is a hardened or cobalt steel which has a high load or stress bearing capacity. The housing 12 can be conveniently manufactured using a steel stock material, such as hot or cold rolled steel and then heat treated or fired to produce the final hardened steel product.

The housing 12 is easily manufactured from U shaped metal stock which is thicker than the final desired product by machining and removing material from the raw stock to provide the desired dimensions. The machining process also provides very smooth interior walls for the housing 12 which allows moving parts confined within the housing to move unimpeded along the walls with low frictional resistance. Those skilled in the art will readily understand the dimensions required to accommodate potential stress and clamping forces produced by given applications. An exemplary wall thickness for a finished housing 12 using hardened steel walls about 2 inches high is about 0.25 inches. However, these dimensions can be changed depending upon specific applications, materials employed, and vise structure the attachment is used with.

In manufacturing the housing 12 a radius is machined into inside corners where the sidewalls and any projections or ridges intersect each other. This radius prevents the build up of stress otherwise associated with square corners and resulting from heat treatment or similar processes or clamping loads. Such stress can lead to material failure during use. Typically a small radius on the order of 0.10 to 0.16 inches alleviates any problems.

The blades 14, as shown in greater detail in FIG. 5, are generally rectangular in cross section and have two parallel side walls 18 where they abut adjacent blades as well as upper 20 and lower 22 faces which guide against the housing 12 to support the blades as they slide back and forth in the housing. These blade surfaces are machined or polished to form very smooth, low friction surfaces to minimize abrasion and drag. This allows a very smooth and low force operation of the blades 14 and improves the lifetime of the attachment 10. As should be apparent to those skilled in the art from the above description, the blades 14 are manufactured to have a precision fit. The sides of the blades 14 are machined or polished so that the blades slide freely without catching or binding. It is also important that the blades move very easily and smoothly within the housing 12 so that the blades do not exert a large counter force on the object to be clamped.

It is an advantage of the present invention that the blades 14 do not exert a strong "counter" or resistance force on an object being clamped while conforming to the shape of the object. This allows the vise attachment 10 to accommodate very thin or fragile objects without damaging or deforming any surfaces. At the same time, the holding strength of the vise attachment 10 is very high.

To capture the blades 14 within the housing 12 so that they extend to a maximum predetermined length and no farther, the upper 20 and lower 22 faces of the blades are shaped to engage a stop or retention means 24 in the housing 12. This is generally accomplished by manufacturing the blades 14 from a stock material approximately as wide as the interior height of the housing 12. The portion of each blade 14 that is to project from the housing 12 is then made narrower and has approximately the same height as the opening in the front of the housing 12, which is less than the interior height of the housing 12. Therefore, the wider back portion of each blade 14 contacts the stops 24 or housing which then stops further outward or forward motion of the blade and prevents escape from the housing.

To again control stress and further reduce abrasion from edge contact, the edges of the upper and lower faces of the blades 14 where the height varies have a small radius. At the same time, the inside corners of the front and side walls of the housing 12 have a matching radius.

The blades 14 are made from materials similar to the housing 12. In order to have a high strength capacity, the blades are preferably made from hardened or cobalt steel or a variety of stainless steel. However, those skilled in the machine arts will appreciate that other materials can be used for applications having less stringent load bearing requirements without departing from the teachings of the present invention.

As discussed above, previous clamping devices generally rely on manual adjustment of each element against an object while some devices employ resilient materials to help adjust element position. A series of locking bolts or hydraulically actuated elements are then used to lock the elements in place once they have conformed to the object shape. However, such bolts or elements have exhibited several operational problems.

Such bolts are directed transverse to the movement of the adjustable elements which greatly reduces their holding power. Large holding or clamping forces can lead to slippage and object movement or damage. Also the relative accuracy or tolerance for element position is affected by slippage or movement induced by turning bolts and screws against the sides of elements.

In the present invention, a substantially non-resilient but comfortable or self-distributing material is positioned behind the blades to both urge the blades into contact with an object and fill any remaining volume once the blades 14 have conformed to an object and lock the blades in place against the object. Therefore, the material behind the blades must be capable of withstanding high compressive forces often encountered in holding objects in place in the vise 5 and yet be mobile for redistribution.

A preferred material is a plurality of hardened steel spheres or balls 26 distributed in a volume adjacent to the back face 30 of the blades 14. The balls 26 are placed in the vise attachment 10 during construction before the end walls are secured to the housing 12 sidewalls. A predetermined number of balls 26 partially fill the housing 12 so that there is a reasonable amount of free volume left when all of the blades 14 are positioned in the frontmost position. The amount of material or the number of balls 26 employed will be readily apparent to those skilled in the art from the dimensional analysis provided below.

When the vise attachment 10 encounters an object surface the blades 14 are forced to retract into the housing 12 and are pressed into the balls 26. The blades 14 in turn move the balls 26 against the back of the housing 12. Once the blades 14 have conformed to the shape of an object and are pressed far enough into the housing, the balls fill all of the volume behind the blades. This then locks the blades 14 into the desired shape about the object. This technique does not allow further slippage or sliding motion of the blades away from the object being held. Therefore, any locking bolt or screw need not support the work load or holding strength of the vise attachment 10 or vise 5.

While this concept does improve the operation of a vise assembly in terms of grasping irregular-shaped objects, there are some potential problems. First, if the back face 30 of the blades 14 is a flat surface the balls can become trapped in uneven distributions and become "packed" behind just a few blades 14. That is, if the blades 14 terminate in a flat planar face 30, some blades can press against and trap a large collection of balls 26 while the remaining volume remains unfilled. This creates an uneven grasping force and possibly inadequate or incomplete object contact by some of the blades which greatly degrades the operation of the vise attachment 10. This can also exert more force on one portion than another of a given blade, causing tilting and other deleterious effects. At the same time, flat planar edges force the balls 26 into the sidewalls of the housing 12 which exerts a fairly large force on the housing. This can cause the sidewalls to deform and ultimately degrade performance or destroy the vise attachment 10.

In order to solve these problems, the preferred embodiment of the present invention uses specially shaped blades 14. The rear projection or face 30 of the blades 14 comprises a generally concave arcuate or curved surface extending between the upper and lower faces 20 and 22. This forms a surface that moves or deflects the balls 26 toward the center of the back face 30. At the same time, the back face has a radius or convex curved surface extending between the two sides 18 which pushes balls 26 toward the sides 18 or ends 13 of the housing 12.

The multi-curved faces 30 move the balls 26 around as the blades are pressed into the housing 12 and prevent the build up of large numbers of balls behind just a few blades. However, a more important effect of this design, is that the balls are repositioned toward the center of each blade so that stress is transferred from the center of the blades into the balls. This decreases lateral forces on the housing 12 sidewalls or uneven forces on the object being clamped. The curved surface also counters gravitational forces by "scooping" the balls 26 upward and inward to the center of the housing and provides a "focusing" affect for the balls 26. In addition, this transfers loads or stress from the front face of the blades 14, through the balls 26 to the back of the housing 12 and to the vise jaws 7. This allows the vise to exert the holding force and not the housing 12 or any locking screws.

As shown in FIGS. 3 and 4, the present invention does not require any type of hand actuation, hydraulic pressure or special levers to "clear" or "reset". Instead, an internal pressure source is used to automatically reset the vise attachment 10 for holding new objects by returning the blades 14 to a "neutral position" once an object is removed from the vise 5.

This is accomplished using a spring 32 and a pressure plate 34. The spring 32 moves the plate 34 toward the front of the housing 12 which in turn presses the balls 26 against the blades 14. As an object is removed from the vise attachment 10, or the vise 5 is readjusted to release the object, the blades 14 no longer exert any pressure on the balls 26. The spring 32 pushes the plate 34 forward which causes the balls 26 to exert a forward driving force on the blades 14 which presses the blades forward and extends them out of the housing 12 until they encounter the stops 24.

The spring 32 can be formed out of a variety of materials but it has been discovered that a serpentine shaped leaf spring out of spring steel is preferred for its strength and long wear capacity. The spring tension or return force is selected so that the blades 14 do not exert a large amount of force or pressure against an object when the vise attachment 10 first contacts object surfaces.

The plate 34 comprises a plate of hardened steel or similar material in order to hold up against the wear of constant friction and abrasion from the balls 26. The plate is dimensioned to be slightly smaller than the height and width of the housing 12. This allows free movement of the plate 34 without allowing any balls 26 to slip behind the plate. A shallow groove is preferably machined in the back of the plate 34 to stabilize the spring and retain it in a fixed lateral position along the plate. This keeps the spring centered while allowing for a spring narrower than the width of the plate. The edges of the plate 34 also have a small radius formed thereon so that no sharp edges protrude against the housing 12 or the balls 26.

As shown in FIG. 3, the preferred embodiment of the plate 34 has a curved front surface 35 which faces the curved faces 30 of the blades 14. The surface 35 has a curvature approximately the same as that of the faces 30. This curved surface acts in the same manner as the curve of the faces 30 to reposition the balls 26 to interact with a more central position of the blades 14 and the plate 34. An exemplary curved surface 34 comprises about a 2.5 inch radius on a plate about 1.50 inches high.

Based on the above description of construction and operation, those skilled in the art will be able to determine the quantity or volume of balls 26 desired for operation of the preferred embodiment of the present invention. The volume to be occupied by the balls 26 comprises the minimum volume remaining behind a blade 14 in its most retracted position within the housing 12, times the total number of blades.

For the embodiment shown in FIG. 3, the minimum volume occurs when the upper and lower edges of the face 30 contact the matching edges of the plate 34. The volume 31 is bounded on two sides by the two arcuate surfaces 30 and 35, and is one blade width in thickness. The number of balls 26 required to fill the volume 31 for a given size of balls 26, (and blades 14, face 30, and surface 35) multiplied times the number of blades 14 used in the vise attachment 10 provides the total number of balls 26 that must be placed within the housing 12. The volume required is similarly figured when either surface 30 or 35 is not curved based on the maximum retraction position of the blade 14.

While the preferred embodiment employs curved surfaces 30 and 35, it has been found that use of the plate 34 in combination with flat surfaces 30 and 35 provides improved operation over prior devices.

The invention thus described allows a typical existing vise to clamp or otherwise support irregularly-shaped objects by insertion or attachment of the vise attachment 10. However, the vise attachment 10 can also be configured for stand alone use, especially where a variety of parts are to be secured to a small work surface or bench.

Independently mounted vise attachments 10', 10'', and 10''' are illustrated in a perspective view in FIG. 2 and the top sectional view of FIG. 4. In FIGS. 2 and 4, a pair of mounting brackets or ears 36 are shown secured to the sides 13' and 13'' of the housings 12' and 12'', respectively. These brackets comprise material such as hardened steel which is welded or otherwise secured to the ends of the elongated housings. The brackets have passages or elongated slots 38 in a central portion so that bolts or screws can be used to secure the brackets, and thus the housings to a desired work surface.

When the vise attachments 10'' are used to create a holding or clamping device as a work surface attachment, there may be some degree of adjustment required to the positioning of the vise blades in addition to the balls 26. That is, since coarse adjustments for the separation of the blades 14 are not provided by a vise 5, another means for altering the overall position of the blades may be desired. Therefore, two or more adjustment bolts or screws 40 are provided along the back wall of the housing 12'' in threaded holes 42. These bolts are adjusted to force the pressure plate 34 against the balls 26 which causes the blades 14 to extend a predetermined distance from the housing 12'' during initial adjustment.

In some applications it is also desirable to have the blades 14 remain set in a particular configuration as where a series of duplicate parts or objects are to be held. For such repetitive operations, set screws 50 are disposed in threaded holes in the end walls of the housing 12. These screws are tightened against the blades 14 once a desired configuration has been achieved. Unlike the prior art, the set screws 50 will not displace the blades 14 and cause slippage because the balls 26 prevent further movement of the blades into the housing 12'.

For many applications it is also desirable to provide some form of lubricant or cleaning solvent to the inside of the housing to help maintain a clean lubricated environment. This promotes a low friction, free flowing movement of the balls 26 within the housing 12'. A spring and ball type oil feed 52 mounted on the ends of the housing 12' is well suited as an access port for this function.

While the vise attachments 10, 10', and 10'' advance the art in terms of economical construction and improved operation, a further advance in the art is obtained if the vise attachment is constructed with an alternate type of blade or element 14.

Figure 6:
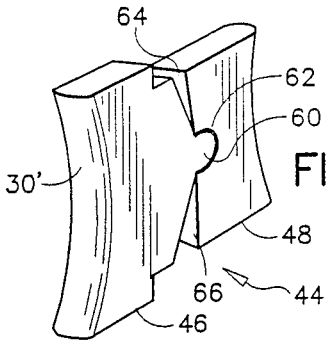
FIG. 6 is a perspective view of another vise blade used in the apparatus of FIGS. 1, 2, and 3.

Illustrated in FIG. 6 is a vise attachment blade 54 which has the same rearward face structure as that of the blades 14 but with a unique clamping or forward face. The blades 54 are divided into a back section 56 and a forward section 58. The back section 56 has the same structure as the blades 14 except for a specially configured front edge 64. The front edge 64 of the blade section 56 comprises two beveled or planar surfaces that slant outward toward the middle of the element 58 and converge toward a central point. The surfaces make a predetermined angle with respect to the side faces of the element 56. At the same time, a cylindrical projection 60 extends from side to side across the face 64 of the element 56 and has a central axis that coincides with the convergence point for the beveled face surfaces.

The rearward facing surface 66 of the front section 58, comprises two slanting surfaces that extend inward from the upper and lower edges and converge toward a central point. The angle of the surfaces on the blade sections 58 is greater or larger with respect to the edges of the blades than the slant or angle found on the blade sections 56. The convergence point of the section 58 has a cylindrical passage 62 positioned laterally between the parallel sides which provides a circular slot. This circular or cylindrical passage is made slightly larger in diameter than the projection 60. The projection 60 is slid into the passage 62 and secures the two sections 56 and 58 together.

The combination of the passage 62 and projection 60 forms a rotatable hinge about which the two sections 56 and 58 move. Since the angles differ on the two mating sections the two are freely rotatable about each other in the vertical direction over a limited angular range determined by the difference in the angles. This means that as each element 54 is pressed against an object, not only do the blades depress into the balls 26 at varying depths, but the blades adjust vertically across the face of the vise attachment 10 to accommodate variations in object contours laterally across the face of the vise attachment. This provides multiple axis adjustment for irregularly-shaped objects.

Returning now to FIG. 2, it is seen that more than two vise attachment devices or assemblies can be used to support an object depending upon the type of support required and the working surfaces available. In addition, very long vise attachment devices 10', 10'', and 10''' can be formed as where especially long parts are to be worked on.

What has been described then, is a new type of vise attachment that provides a low complexity, cost effective solution to several problems in the art and advances the art of holding and clamping devices.

The foregoing description of preferred embodiments has been presented for purposes of illustration and description. It is not intended to be exhaustive nor to limit the invention to the precise form disclosed, and many modifications and variations are possible in light of the above teaching. The embodiments were chosen and described to best explain the principles of the invention and its practical application to thereby enable others skilled in the art to best utilize the invention in various embodiments and with various modifications as are suited to the particular use contemplated. It is intended that the scope of the invention be defined by the claims and their equivalents.

What I claim is:

1. A vise attachment for use on a vise assembly for holding objects having irregularly-shaped surfaces, comprising:

a compact housing having an elongated opening on one side;

a plurality of holding elements slidably mounted adjacent to each other within said opening, each element having opposing front and back faces, said elements being movable between a retracted position with said front face adjacent to said housing and an extended position with said front face positioned away from said housing;

stop means coupled between said elements and said housing for interacting with said housing and setting a predetermined limit for extension of said front face from said housing when in the extended position;

a self distributing substantially non-resilient medium positioned within said housing adjacent said back faces of said elements having a predetermined volume for filling said housing when said elements are in a retracted position; and reset and distribution means for automatically exerting a force on said elements and said medium and for causing said front face of said elements to move through said opening until prevented from moving further by said stop means or an object, comprising:

a pressure plate disposed between a back side of said housing and said medium, said back side being opposite said elongated opening; and spring means disposed between said pressure plate and said housing back side for urging said plate towards said element back faces.

2. The vise assembly of claim 1 further comprising adjustment means coupled between said housing and said pressure plate for manually adjusting a position for said plate with respect to sidewalls of said housing.

3. The vise attachment of claim 1 further comprising an angled bracket secured to said housing and extending toward a jaw portion of the vise so as to hook over at least one edge of said jaw.

4. The vise attachment of claim 1 wherein each of said holding elements comprises:

a generally rectangular plate member having two substantially parallel sides and front, back, upper, and lower faces, said sides and front face being smooth planar surfaces, said back face configured in the form of a concave arc extending between said upper and lower faces; and stop means for interacting with said housing and setting a predetermined limit for extension of said front face from said housing when in the extended position.

5. The attachment device of claim 4 wherein said reset means comprises:

a pressure plate disposed between a back side of said housing and said medium, said back side being opposite said elongated opening, said pressure plate having a curved front surface facing said element back faces; and spring means disposed between said pressure plate and said housing back side for urging said plate toward said element back faces.

6. The attachment device of claim 4 wherein said elements have a front extension portion for extending outside of said housing and a rear capture portion for remaining inside of said housing and interacting with said spheres, with a separation between the upper and lower faces of the extension portion being approximately the same as a corresponding dimension of said rectangular opening and said stop means comprises a larger separation distance between said upper and lower faces in said rear capture portion.

7. The attachment device of claim 4 wherein the front face of said blades comprise a surface having a radius formed along its periphery.

8. The vise attachment of claim 4 wherein said blades further comprise:

a pivot member rotatably secured to said blade front face, said pivot member having a front contact face, top and bottom faces, and a rear support surface, said rear support surface comprising first and second planar support surfaces extending between a vertical position centrally located between the top and bottom faces and the top and bottom faces respectively and making a predetermined first angle therewith to project away from said contact face;

a cylindrical projection extending from the rear support surface, said projection having a longitudinal axis traversing said rear support surface at said central vertical position;

said blade front face having first and second planar surfaces extending between a vertical position centrally located between the upper and lower faces and the upper and lower faces respectively and making a predetermined second angle therewith to project toward said back face, said second angle being greater than said first angle; and a cylindrical passage disposed in said front face, said passage having a central longitudinal axis traversing across said front face at said central vertical position, said cylindrical passage having a diameter larger than said cylindrical projection for accommodating and confining said projection in a rotatable manner.

9. The attachment device of claim 1 wherein said back faces of said blades further comprise a concave arcuate surface having a radius formed along its periphery.

10. The attachment device of claim 1 wherein said substantially non-resilient medium comprises a plurality of self distributing non-resilient spheres positioned within said housing adjacent said back faces of said blades having a predetermined volume for filling said housing when said blades are in a retracted position.

11. The attachment device of claim 10 wherein said spheres are manufactured from a material chosen from the group of hardened steel, cobalt steel, or stainless steel.

12. The vise attachment of claim 1 wherein said back faces comprise arcuate surfaces.

13. The vise attachment of claim 1 wherein said pressure plate has a curved surface facing said back surfaces.

14. The vise assembly for holding objects from more than one direction, comprising:

at least two compact housings each having a rectangular opening on one side;

a plurality of blades disposed adjacent to each other and slidably mounted within said rectangular opening and movable between an extended position and a retracted position, each blade comprising:

a generally rectangular plate member having two substantially parallel sides and front, back, upper, and lower faces, said sides and front face being smooth planar surfaces, said back face configured in the form of a concave arc extending between said upper and lower faces; and stop means disposed on said upper and lower faces for interacting with said housing and setting a predetermined limit for extension of said front face from said housing when in the extended position;

a plurality of self distributing non-resilient spheres positioned within said housing adjacent said back faces of said blades having a predetermined volume for filling said housing when said blades are in a retracted position; and reset means for causing said front face of said blades to move through said rectangular opening until prevented from moving further by said stop means or an object.

15. The vise assembly of claim 14 further comprising at least three housings each having a rectangular opening on one side with a plurality of blades disposed adjacent to each other and slidably mounted within said rectangular opening and movable between an extended position and a retracted position.

16. The vise assembly of claim 14 further comprising attachment means secured to said end walls for securing said vise assembly to a fixed surface.

17. The vise assembly of claim 16 wherein said attachment means comprise a planar extension projecting from said end walls having an aperture for passage of a fastening means for securing the vise assembly to a surface.

18. A vise attachment for use on a vise assembly for holding objects having irregularly-shaped surfaces, comprising:

a compact housing having an elongated opening on one side;

a plurality of holding elements slidably mounted adjacent to each other within said opening, each element having opposing front and back faces, and substantially planar side faces disposed therebetween, said elements being movable between a retracted position with said front face adjacent to said housing and an extended position with said front face positioned away from said housing;

stop means coupled between said elements and said housing for interacting with said housing and setting a predetermined limit for extension of said front face from said housing when in the extended position;

a self distributing substantially non-resilient medium positioned within said housing adjacent said back faces of said elements having a predetermined volume for filling said housing when said elements are in a retracted position;

reset and distribution means for automatically exerting a force on said elements and said medium and for causing said front face of said elements to move through said opening until prevented from moving further by said stop means or an object; and focusing means for focusing forces exerted by and between said back faces and said medium due to interaction with objects against said front faces, to a central portion of said back faces.

19. The vise attachment of claim 18 wherein said back faces comprise arcuate surfaces.

20. The vise attachment of claim 18 wherein said force direction means comprises an arcuate back surface on each of said elements so as to position a majority of said medium adjacent a central location of said elements.

* * * * *